United States Patent [19]

Ito et al.

[11] Patent Number: 4,649,640

[45] Date of Patent: Mar. 17, 1987

[54] METHOD FOR MANUFACTURING A MOLDED TRANSFORMER

[75] Inventors: Yoshihiro Ito, Aichi; Tooru Ochiai, Yokkaichi, both of Japan

[73] Assignee: Kabushiki Kaisha Toshiba, Kawasaki, Japan

[21] Appl. No.: 717,028

[22] Filed: Mar. 28, 1985

[30] Foreign Application Priority Data

Apr. 4, 1984 [JP] Japan ..... 59-67085

[51] Int. Cl.[4] ..... H01F 41/12

[52] U.S. Cl. ..... 29/605; 29/606; 264/134; 264/272.13; 264/272.19; 427/116

[58] Field of Search ..... 264/272.19, 134, 272.13, 264/102; 427/116; 29/605, 606

[56] References Cited

U.S. PATENT DOCUMENTS

| | | | |
|---|---|---|---|
| 2,318,095 | 5/1943 | Putman | 264/248 |
| 3,243,752 | 3/1966 | Lawrence | 264/272.19 |
| 3,274,320 | 9/1966 | Reber | 264/272.19 |
| 3,633,140 | 1/1972 | Lake | 264/272.19 |
| 3,991,232 | 11/1976 | Kamiuchi et al. | 264/272.19 |
| 4,179,796 | 12/1979 | Allen | 264/272.19 |
| 4,333,900 | 6/1982 | Carey | 264/272.19 |
| 4,491,555 | 1/1985 | Cork | 264/272.19 |

*Primary Examiner*—James Lowe

*Attorney, Agent, or Firm*—Oblon, Fisher, Spivak, McClelland & Maier

[57] ABSTRACT

A method for manufacturing a molded transformer comprises the steps of forming a coil by winding concentric layers of a conductor with insulating layers interposed between the adjacent layers of the conductor and provided with insulating end members at both ends of the respective layers of the conductor, providing insulating layers on the inner and outer surfaces of a resultant structure, applying a curing accelerator to the insulating layers on the inner and outer peripheral surfaces and the insulating end members at one end of the coil, assembling a wound core in the coil to form a core-coil assembly, immersing the assembly in resin with said one end of the coil directed downward, taking out the assembly when the resin starts to gel due to the action of the curing accelerator, and then setting the resin in the coil and on the wound core.

4 Claims, 6 Drawing Figures

METHOD FOR MANUFACTURING A MOLDED TRANSFORMER

BACKGROUND OF THE INVENTION

1. Field of the Invention

The present invention relates to a method for manufacturing a molded transformer with a wound core.

2. Description of the Related Art

In conventional molded transformers, coils impregnated with a resin are combined with a laminated core after the resin is set. These days, however, the molded transformers are expected to have reduced iron loss as well as reduced size and weight. To meet these requirements, for example, a wound core permitting less iron loss and lower exciting current is tried in place of the laminated core, as in the case of an oil-immersed transformer.

In manufacturing such a molded transformer with a wound core, however, if resin-molded coils are combined with the wound coil, it is difficult to prevent rusting of the leg portions of the wound core, which are located within the coil, and generation of noise due to vibration.

To cope with this difficulty, a method may be adopted in which a wound core-coil assembly consisting of a wound core and coils wound therearound is immersed in varnish or resin in a reservoir so that the varnish or resin adheres to the assembly, and the assembly is then taken out from the reservoir and put into a drying furnace to cure the varnish or resin. In this method, however, the varnish or resin in a liquid phase drips when the wound core-coil assembly is removed from the reservoir. Thus, it is impossible to obtain a uniform resin layer. Moreover, voids may remain in the varnish or resin, causing defective insulation or lowering adhesive strength. Also, the thermal conductivity may be lowered, resulting in deterioration of the heat radiation characteristic.

As with small molded transformers for a measuring instrument, etc., a method may be proposed in which a one-coil assembly consisting of a wound core and coils wound therearound is put into a die, and a resin is impregnated into the assembly and thermally set to form an integral molding. When this method is applied to the distribution transformer, the resin thickness is increased, and the interior of the transformer is heated at a high temperature when the coils are energized. The injected resin cracks due to the difference in thermal expansion coefficients between the wound core and the resin, as well as its increased thickness, thus lowering its insulating capability. In order to prevent the cracking, a shock absorbing member may be provided around the wound core. The use of such a member may, however, result in a complicated structure of the transformer. Moreover, since the coil generally requires cooling ducts, the manufacture of the cooling ducts necessitates the use of a die with a complicated construction.

Furthermore, a method is disclosed in Japanese Patent Publication No. 25127/77 in which a molded wound core is divided into two and the outer surface is coated with rust-resistant paint with its divided ends contacting together. The divided ends are coated with an adhesive agent, and then the wound core is assembled into coils. Thereafter the divided ends of the core are joined together.

This method is subject to the drawback that the adhesive agent on the joined ends of the wound core deteriorates over time, and this results in noise during the operation of the transformer.

SUMMARY OF THE INVENTION

A method for manufacturing a molded transformer comprises the steps of forming a coil by winding concentric layers of a conductor with insulating layers interposed between the adjacent layers of the conductor and provided with insulating end members at both ends of the respective layers of the conductor, providing insulating layers on the inner and outer peripheral surfaces of a resultant structure, applying a curing accelerator to the insulating layers on the inner and outer peripheral surfaces and also the insulating end members at one end of the coil, assembling a wound core in the coil to form a core-coil assembly, immersing the assembly in resin, taking out the assembly when the resin begins to gel by the action of the curing accelerator, and then setting the resin in the coil and on the wound core.

BRIEF DESCRIPTION OF THE DRAWINGS

The present invention can be fully understood from the following detailed description with reference to the accompanying drawings, in which.

DETAILED DESCRIPTION OF THE PREFERRED EMBODIMENTS

Figure 1:
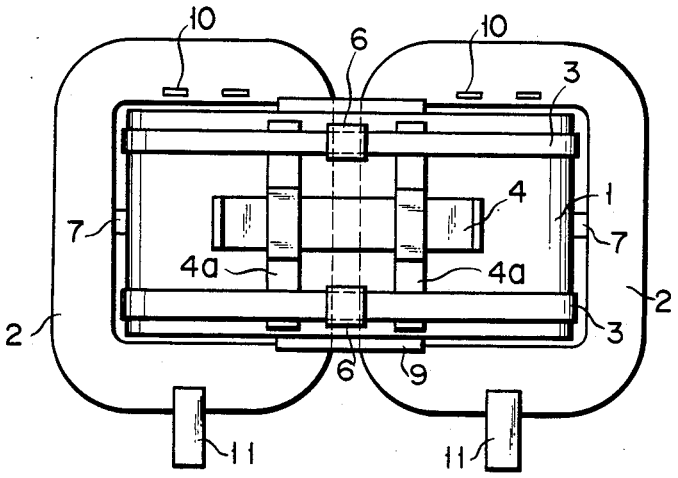
FIG. 1 is a plan view of one embodiment of a molded dry-type transformer manufactured according to the present invention.
Figure 2:
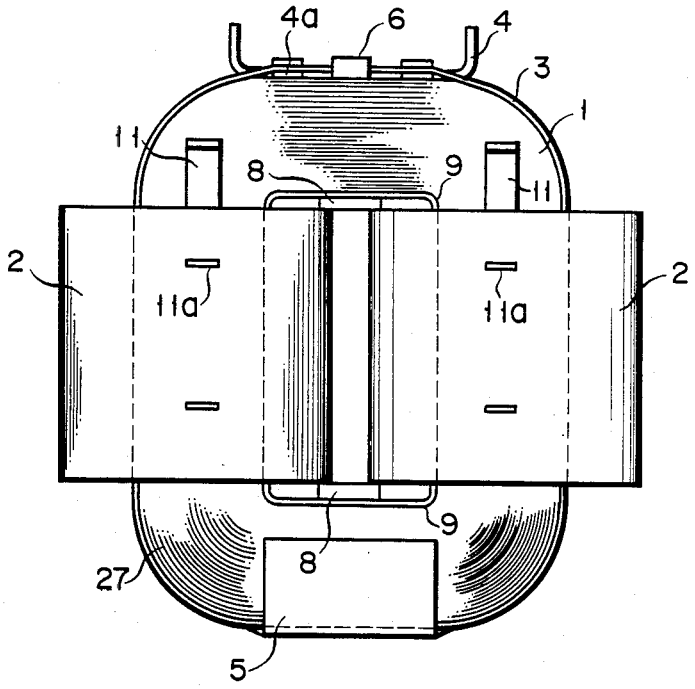
FIG. 2 is a front view of the transformer of FIG. 1.

FIGS. 1 and 2 show one embodiment of a molded transformer manufactured by a method according to the present invention.

Figure 3:
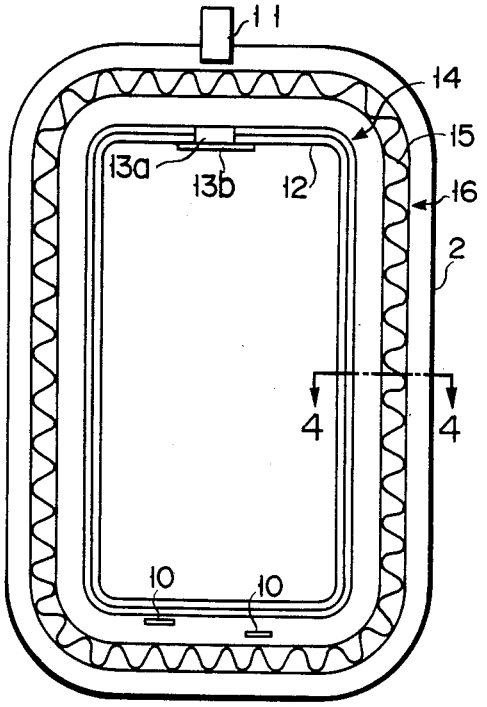
FIG. 3 is a plan view of one embodiment of a coil used in the transformer manufactured according to the invention.
Figure 4:
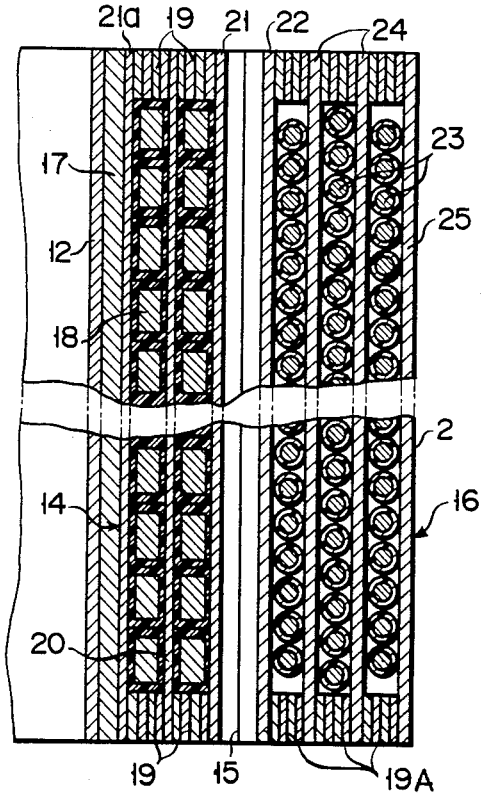
FIG. 4 is a sectional view taken along line 4—4 of FIG. 3.

Referring now to FIGS. 3 and 4, a process for fabricating a coil 2 of the transformer shown in FIGS. 1 and 2 will be described in detail.

A silicon steel plate can be formed in any shape into a frame 12 conformable to the configuration of the inner peripheral surface of the coil 2 to be manufactured. The ends of the frame 12 are separated from each other for preventing short circuits. An insulating member 13*a*, which may be an aromatic polyamide heat-resistant board or an epoxy glass laminate plate, is interposed between both the ends of the frame 12 and fixed by an adhesive tape 13*b* thereto for insulation therebetween.

An insulating paper or pressboard is wound around the outer peripheral surface of the frame 12 to form an insulating layer 17 thereon. Around the outer peripheral surface of the insulating layer 17 is wound an insulating material with high resin impregnability such as glass tape previously coated with a curing accelerator or heat-resistant nonwoven fabric to form a first inner peripheral insulating layer 21*a*. A rectangular electrical conductor (first electrical wire) 18 insulated by a polyamide tape such as NOMEX (Du-Pont's trademark) is wound in layers around the outer peripheral surface of the first inner peripheral insulating layer 21*a*. Insulating end members 19 made of a material with high resin impregnability such as rock wool or heat-resistant nonwoven fabric are wound on the axial end portions of the first inner peripheral insulating layers 21*a*. A plurality of wound layers of the conductor 18 and end insulating members 19 are concentrically wound with interposition of first insulating layers or layer insulators 20 formed of heat-resistant nonwoven fabric. An insulating material with high resin impregnability (as mentioned above) is wound around the outer peripheral surface of the resultant structure to form a first outer peripheral insulating layer 21. Thus, a secondary coil 14 is completed.

Then, a corrugated band-shaped insulating member formed of epoxy-glass prepreg or heat-resistant nonwoven fabric is wound around the outer peripheral surface of the first outer peripheral insulating layer 21 to form a main insulating layer 15. Further, glass tape previously coated with a curing accelerator or heat-resistant nonwoven fabric is wound around the main insulating layer 15 to form a second inner peripheral insulating layer 22. Then, a conductor (second electrical wire) 23 with a circular cross section insulated in the same manner as the conductor 18 is wound around the outer peripheral surface of the second inner peripheral insulating layer 22, and the insulating end members 19A are wound on both axial end portions of the wound layers of the conductor 23. Wound layers of the conductor 23 and end insulating members 19A are concentrically wound with layer insulators (second insulating layers) 24 interposed therebetween. Glass tape previously coated with a curing accelerator and/or heat-resistant nonwoven fabric is wound around the outer peripheral surface of the resultant structure to form a second outer peripheral insulating layer 25. Thus, a primary coil 16 is completed. The coil 2 is formed having air ducts axially extending between the main insulating layer 15 and the first outer peripheral insulating layer 21 and between the main insulating layer 15 and the second inner peripheral insulating layer 22. Then, the curing accelerator is applied to the insulating end members 19 at the lower end portion of the coil 2 and to the lower end portions of the layer insulators 20 and 24. Thus, the curing accelerator is applied to the inner and outer peripheral surfaces and the bottom surface of each of the primary and secondary coils 16 and 14. CUREZOL 1B2MZ (mainly containing 1-benzyl-2-methylimidazole) or CUREZOL 2E4MZ (mainly containing 2-ethyl-4-methylimidazole) (trademarks of Shikoku Chemicals Corporation) may be used as the curing accelerator. The curing accelerator is dissolved in ethyl alcohol to prepare a 10% solution. The insulators are immersed in the solution and then taken out. Thereafter the solvent is evaporated. Aromatic polyamide nonwoven fabric, e.g., H-8008CT or H-8160CT (both trademarks) produced by Nihon Vilene Co., Ltd., may be used as the heat-resisting nonwoven fabric.

Figure 5:
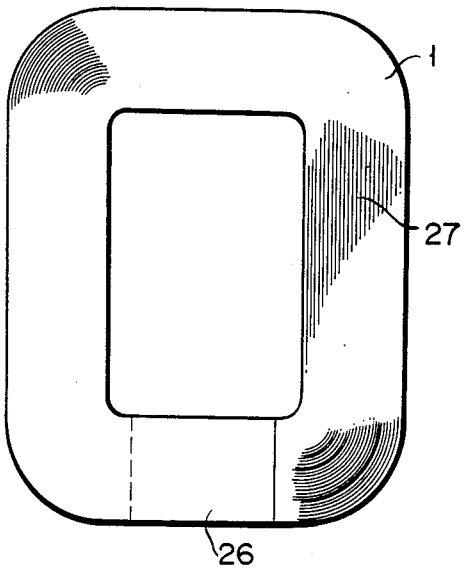
FIG. 5 is a front view of one embodiment of a wound core with overlapping junctions used in the transformer manufactured according to the invention.
Figure 6:
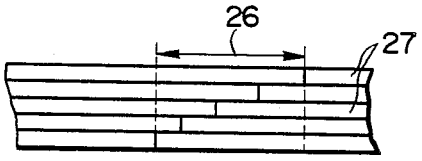
FIG. 6 is an enlarged view showing the overlapping junctions of the wound core of FIG. 5.

A process for manufacturing a wound core 1 will now be described. As shown in FIGS. 5 and 6, the wound core 1 is of a so-called one-turn-cut type. A magnetic band plate 27 (e.g., a silicon steel plate) is wound, and a cut portion is formed for each turn of the band plate 27 so that the cut portions are arranged in a slant or in zigzags. For a single-phase 100 kVA (50 Hz) type transformer, the wound core 1 is fabricated as follows. After the magnetic band plate 27 is formed into a circular roll, it is shaped into a rectangular form and annealed. Then, the magnetic band plate 27 is unwound and cut for every turn with a displacement of 5 to 10 mm between every two adjacent turns. The so cut magnetic band plate pieces are assembled into the original laminated rectangular forms to complete the wound core 1 having an overlapping cut portion 26, as shown in FIGS. 5 and 6. The overlapping cut portion 26 reduces magnetic flux leakage in the wound core 1, whereby iron loss and exciting current are decreased.

Then, the wound core 1 is opened at the cut portion 26, and a pair of leg portions of the wound core 1 are fitted in their corresponding coils 2 with their end faces applied with the curing accelerator facing on the same side. The yoke portion of the wound core 1 is fitted on its inner peripheral surface with a yoke insulating member 9 which is formed of a heat-resistant board (e.g., RA Board or GA Board produced by Nippon Aroma Co., Ltd.) and is complementary to the inner peripheral surface of the yoke portion. Pads 8 made of a heat-resistant board (such as the previously mentioned RA Board) are inserted between the yoke insulating member 9 and the end portion of the coils 2. Subsequently, a lifting lug 4 with cross bars 4*a* welded thereto is mounted on the outer surface of the wound core 1 on the side of the end faces of the coils 2 which are free from the curing accelerator. A base member 5 is disposed on the outer surface of the wound core 1 on the side of the end faces of the coils 2 which are coated with the curing accelerator. Thereafter, bands 3 are wound around the outer peripheral surface of the wound core 1, and both ends of each band 3 are clamped by means of a clamp member 6 so that both end portions of the cross bars 4*a* and the base member 5 are fixed on the outer surface of the wound core 1. Finally, spacers 7 are inserted between the inner surfaces of the coils 2 and their corresponding leg portions of the wound core 1, whereby the position of the coils 2 remains unchanged relative to the wound core 1. Thus, the wound core 1 and the coils 2 are securely fixed to one another, and the lifting lug 4 and the base member 5 are fixed to the wound core 1. Before the coils 2 are combined with the wound core 1, primary and secondary terminals 10 and 11 and taps 11*a* are provided.

The wound core-coil assembly is heated in a drying furnace to evaporate water from the insulators and the wound core. Then, the assembly is hung at the lifting lug 4 to be immersed in resin in a tank so that the end faces of the coils 2 treated with the curing accelerator face downward. Thus, the assembly is impregnated with the resin under a vacuum, and then pressurized for complete impregnation. The resin used may be a mixed resin of imide and epoxy, e.g., Toshiba IMIDALLOY TBV 2703 (trademark). The resin is heated at a temperature ranging from 80° to 90° C., and the wound core-coil assembly is impregnated with the resin for one to two hours. During the impregnation process, the resin adhering to the inner and outer surfaces and the bottom surfaces of the primary and secondary coils starts to gel quickly due to the action of the curing accelerator.

When the resin has gelled, the wound core-coil assembly is taken out from the tank and heated at 180° to 200° C. in a drying furnace for 10 to 20 hours. The resin is fully set, and thus a molded dry-type transformer is completed.

Although the curing accelerator is applied to the lower ends of the coils 2 after the coils 2 are formed, it can alternatively be applied in advance to the insulating end members 19 on the lower end side which are wound simultaneously with the formation of the coils 2. In this case, it is necessary that the resin be prevented from leaking from the lower end portions of the layer insulators 20 and 24 by inwardly bending the lower end portions of the insulating end members 19 or by coating them with the curing accelerator.

In the manufacture of the transformer, the resin gel seals the inner and outer peripheral surfaces and the bottom surfaces of the coils 2, so that no liquid resin in the coils 2 leaks out in the drying furnace or during transportation from the resin tank to the drying furnace.

Even if the resin gels on and around the portion treated with the curing accelerator, the resin in the spaces between the main insulating layer 15 and the insulating layers 21 and 22 and between the wound core 1 and the coils 2 remains in a liquid state, and then most of it flows down to keep the spaces vacant. Accordingly, these spaces serve as cooling air ducts during the operation of the transformer, improving its cooling efficiency.

Such a suitable use of the curing accelerator removes extra resin from the coils 2, the wound core 1, spacers 7, and the pads 8 away from extra resin, preventing those members from cracking.

Further, since the wound core 1 is also immersed in the resin, all the faces of the wound core 1 are covered with the resin, preventing the faces from being exposed to the air. Thus, rust-causing moisture is kept away from the wound core 1, and noise due to magnetic vibration during the operation of the transformer can be further reduced compared with the conventional transformer.

Although the lifting lug 4 is fixed to the wound core 1 by the bands 3, the connection therebetween is much more enhanced if they are bonded together by resin in addition to the use of the bands 3.

Furthermore, since the inner peripheral surface of the yoke portion of the wound core 1 is completely covered with the yoke insulating member 9 to be insulated from the coils 2, partial discharge does not occur in air gaps between the yoke insulating member 9 and the coils 2 under service electric stress. Thus, the distance between the coils 2 and the yoke portion of the wound core 1 can be reduced compared with the conventional transformer.

In the molded transformer according to the embodiment described above, the used wound core is of a one-turn-cut type. Alternatively, the wound core may be of a C-cut type or a non-cut type in which the wound core is wound directly on the coil.

In the above embodiment, the molded transformer has been described as being of a single-phase type. However, the present invention can be also applied to a three-phase type transformer.

Instead of the frame 12 formed of a silicon steel plate, an insulating cylinder formed of an epoxy resin or heat-resistant board may be used for the wound core 1. In this case, the insulating layer 17 may be omitted.

What is claimed is:

1. A method of manufacturing a molded transformer, said method comprising the steps of:

(a) forming each of at least two coils by:

(i) winding on a frame a first insulated electrical wire in a coil and in layers with first insulating layers interposed between the adjacent layers of said first insulated electrical wire and with first insulating end members of high resin impregnability disposed on both ends of the respective layers of said first insulated electrical wire;

(ii) winding on said first insulated electrical wire a first outer peripheral insulating layer on the outer surface of which a curing accelerator has previously been applied;

(iii) winding on said first outer peripheral insulating layer a corrugated main insulating layer which form air ducts;

(iv) winding on said corrugated main insulating layer an inner peripheral insulating layer on the inner surface of which a curing accelerator has previously been applied;

(v) winding on said inner peripheral insulating layer a second insulated electrical wire in a coil and in layers with second insulating layers interposed between the adjacent layers of said second insulated electrical wire and with second insulating end members of high resin impregnability disposed on both ends of the respective layers of said second insulated electrical wire;

(vi) winding on said second insulated electrical wire a second outer peripheral insulating layer on the outer surface of which a curing accelerator has previously been applied; and (vii) applying a dissolved curing accelerator on said first and second insulating end members on one end of each of said at least two coils;

(b) forming a core-coil assembly by:

(i) combining a one-turn, cut-type wound core with said at least two coils and (ii) putting spacers between said at least two coils and said one-turn, cut-type wound core, thereby making said at least two coils immovable relative to said one-turn, cut-type wound core;

(c) drying said core-coil assembly in a drying furnace;

(d) immersing said core-coil assembly with the insulating end members applied with said curing accelerator facing downwardly in a tank containing resin;

(e) impregnating said core-coil assembly with the resin by first producing a vacuum in said tank, then pressurizing said tank to complete impregnation;

(f) taking out said core-coil assembly when the resin on and close to said curing accelerator starts to gel due to the action of said curing accelerator and while the remaining portion of the resin is still in a liquid state; and (g) heating said core-coil assembly in a drying furnace, thereby setting the resin impregnated in said first and second insulating end members, in said first and second outer peripheral insulating layers, in said inner peripheral insulating layer, and on said one-turn, cut-type wound core.

2. The method according to claim 1, wherein said one-turn, cut-type wound core is cut with a displacement between every two adjacent turns.

3. The method according to claim 1, wherein, in step (d), said core-coil assembly is immersed in a mixed resin of imide and epoxy at a temperature of 80° to 90° C. for 1 to 2 hours.

4. The method according to claim 1, wherein said core-coil assembly is thermally set at a temperature of 180° C. to 200° C. in said drying furnace for 10 to 20 hours.

* * * * *